US006340043B1

(12) United States Patent
Paupardin

(10) Patent No.: US 6,340,043 B1
(45) Date of Patent: Jan. 22, 2002

(54) DEVICE FOR SEALING A SYSTEM FOR CONDITIONING PRODUCTS ON A PALETTE

(76) Inventor: Michel Paupardin, Route de Quelen, 62360 Isques (FR)

( * ) Notice: Subject to any disclaimer, the term of this patent is extended or adjusted under 35 U.S.C. 154(b) by 0 days.

(21) Appl. No.: 09/486,386

(22) PCT Filed: Jul. 30, 1998

(86) PCT No.: PCT/FR98/01690

§ 371 Date: Feb. 28, 2000

§ 102(e) Date: Feb. 28, 2000

(87) PCT Pub. No.: WO99/11141

PCT Pub. Date: Mar. 11, 1999

(30) Foreign Application Priority Data

Aug. 28, 1997 (FR) ..... 97/10874

(51) Int. Cl.[7] ..... B32B 31/00
(52) U.S. Cl. ..... 156/382; 156/580
(58) Field of Search ..... 156/381, 382, 156/580, 583.1, 82, 497

(56) References Cited

U.S. PATENT DOCUMENTS 5,580,415 A * 12/1996 Diekwisch ..... 156/382
5,707,476 A * 1/1998 Bezama et al. ..... 156/285
5,707,480 A * 1/1998 Bezama et al. ..... 156/382
5,820,724 A * 10/1998 Diekwisch ..... 156/382

FOREIGN PATENT DOCUMENTS

DE 2701660 7/1978
GB 1274984 5/1972

* cited by examiner

*Primary Examiner*—James Sells
(74) *Attorney, Agent, or Firm*—Miles & Stockbridge P.C.; Edward J. Kondracki

(57) ABSTRACT

A series of flexible sheets are used around a pallet with products thereon, the pallet being disposed in a tunnel. The flexible sheets fill with air pressure supplied at one end of the tunnel such that air leakage around the periphery of the pallet and products is prevented. The arrangement is used to maintain the products at desired temperatures.

3 Claims, 2 Drawing Sheets

DEVICE FOR SEALING A SYSTEM FOR CONDITIONING PRODUCTS ON A PALETTE

The present invention concerns a device for sealing a product temperature holding, reheating or cooling system on a pallet placed in a tunnel.

The term "pallet" is used to denote an element which constitutes a support, but also to denote a unit constituted by this support element and a pile of products mounted on this element (in this case, the expression "support and products unit" appears in brackets).

As for the term "tunnel", this is a unit including:

arranged walls for delimiting, by means of two approximately horizontal upper and lower surfaces and two approximately vertical side walls, a passage with an approximately rectangular cross section, and also receiving a pallet and its products with a wide play, that is a play permitting the loading and unloading from the tunnel without any impacts occurring despite the pallet being improperly handled by a conventional device, such as a fork lift truck, a device for blowing air at a specific temperature into the tunnel and also in a specific direction, The device of the invention is able to resolve the major drawback encountered in the type of application, namely the leaking of air around the pallet (support and products unit).

In fact, to date sealing has only been ensured at the inlet or outlet of the pallet (support and products unit) by a joint or brush.

In the invention, sealing effected with the aid of a sheet is obtained via the pressure of the air ensuring ventilation of the pallet (support and products unit).

When the ventilator is in operation, the air meets the pallet (support and products unit) which creates a pressure upstream of the system, whereas downstream of the latter, the relative pressure is nil.

This has the effect of glueing the sheet which is used for sealing on the sides and top of the pallet (support and products unit) .

This device avoids any leak of air around the pallet (support and products unit) and minimises motor ventilator powers.

This invention is particularly intended for cooling milky products (yoghurts, dessert cream) in the dairy industry.

To this effect, the aim of the invention is to provide a device characterised in that inside the tunnel, so as to avoid any leak of ventilation air around the products situated on the pallet, sealing is effected with the aid of a sheet glued onto the sides and top of the products under the effect of the pressure of the ventilation air which circulates inside said tunnel.

The invention shall be more readily understood from a reading of the following description given by way of non-restrictive example with reference to the accompanying drawings illustrating the invention.

Figure 1:
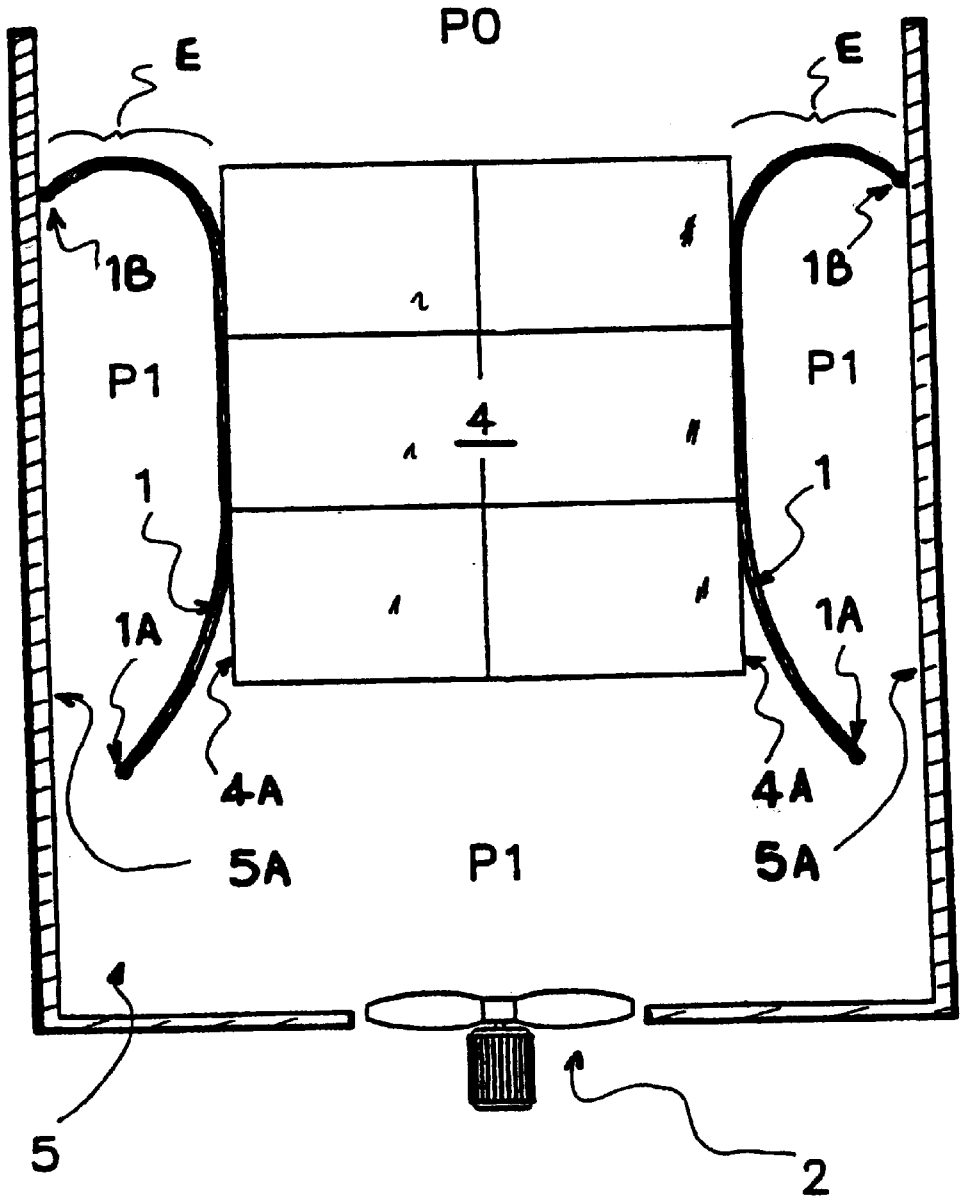
FIG. 1 represents a top view section.
Figure 2:
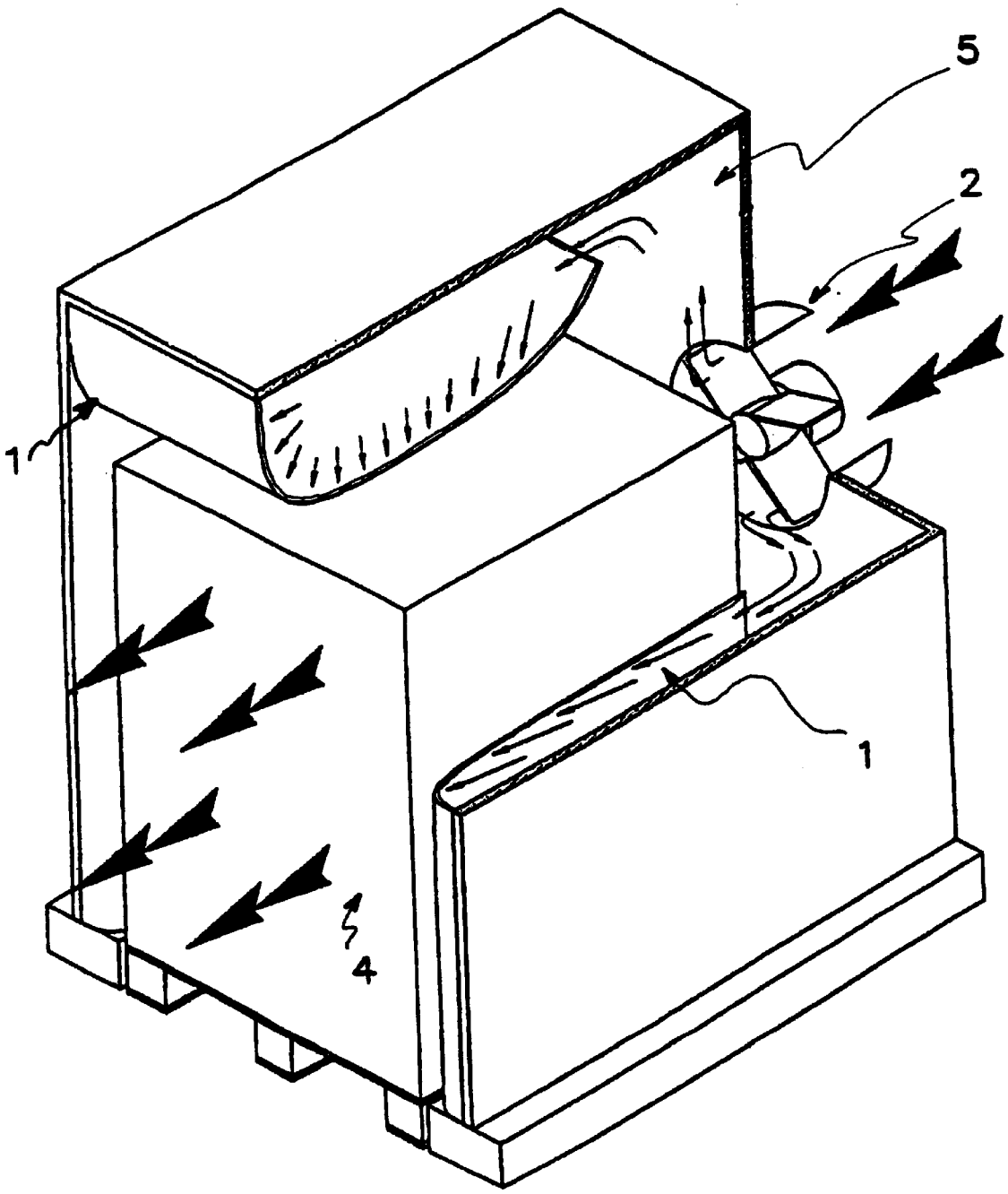
FIG. 2 represents the general perspective view.

With reference to the drawing, a tunnel 5 is shown, that is a functional portion of a product temperature adjustment installation (not shown), such as groups of pots of milky products stacked on a handling support, namely a pallet.

Although this does not appear on the drawing, the products in each group are conventionally arranged with a certain amount of spacing allowing air to circulate between them.

The term "pallet" is hereafter used to denote an element which constitutes a support.

The pile of products and the pallet form a unit with an approximately rectangular parallelepiped shape.

The support unit 4 and pile of products conventionally has a rectangular cross section.

As for the tunnel 5, the term denotes a unit including :

walls fitted in such a way so as to delimit, by means of one lower surface and one upper surface both approximately horizontal and two approximately vertical side surfaces a passage with an approximately rectangular cross section and also to receive a pallet and products unit 4 with a wide play, this is a play allowing loading and unloading from the tunnel 5 without causing any collision despite the pallet being improperly handled by a conventional device, such as a fork lift truck (not shown), a device 2 for blowing air at a specific temperature into the tunnel 5 and in a specific direction,.

The device of the invention is aimed at firstly effectively obstructing the leaking of air laterally and above the pile of products, that is via the existing play between each lateral face of the pile and the lateral face opposite the tunnel 5, and secondly between the upper face of the pile and the face opposite the tunnel 5.

To this effect, so as to avoid each leak of ventilation air around the products situated on the pallet, imperviousness in the tunnel 5 is effected with the aid of a sheet 1 disposed so as to be glued onto the sides and top of the products under the effect of the pressure of the ventilation air circulating in said tunnel.

In the invention, imperviousness effected by means of the sheet 1 is obtained by the pressure of the air ensuring ventilation of the pallet (support and products unit).

The sheet is understood to be a lap made of a flexible material.

On the operational diagram, when putting the ventilator 2 into service, the air (symbolised by the black arrows) strikes the pallet 4 (support and products unit) which creates a pressure (P1) upstream of the system, whereas downstream of the latter, the pressure is nil (P0).

This has the effect of glueing the sheet used for sealing on the sides and top of the pallet (support and products unit).

This device prevents any air from leaking around the pallet and minimises ventilator motor powers.

The device of the invention is notable in that it includes several sheets 1 and each sheet 1 is placed in a space E existing between a surface 4A of the products and support unit 4 and a surface 5A of the tunnel situated opposite so as to, by inflating under the pressure of the air propelled into the tunnel for traversing the pile of products, close the space E in question and limit the circulation of air in passages existing between the products.

The device of the invention is also notable in that:

each sheet 1 has two edges 1A, 1B, one being situated upstream and the other 1B downstream of the tunnel, having regard to the direction of circulation of the air through the products stacked on the pallet, and between these edges 1A, 1B, the sheet 1 has one developed dimension greater than the rectilinear distance separating said edges 1A, 1B so as to constitute a flexible pocket, at the level of its downstream edge 1A, the sheet 1 is fixed, at least indirectly, against the face 5A of the tunnel 5 at the level from which it extends, at the level of its upstream edge 1B, the sheet 1 is kept spaced from the face 5A of the tunnel 5 at the level from which it extends so that the propelled air is able to be caught inside the volume delimited by this lap against the face of the tunnel, and because of this the increase of the resultant pressure provokes this sheet 1 being applied against the support and products unit 4.

What is claimed is:

1. Sealing device for a temperature adjustment system of products situated on a pallet placed in a ventilation circulation tunnel, characterised in that, sealing in the tunnel (5) is effected with a sheet (1) disposed so as to be glued on the sides and top of the products under the effect of the ventilation air circulating in said tunnel and wherein the sheet is operable to block leakage of ventilation air around the products situated on the pallet.

2. Sealing device according to claim 1, characterised in that the sealing device includes several sheets (1), each sheet (1) being placed in a space (E) existing between a surface (4A) of the products and support unit (4) and a surface (5A) of the tunnel situated opposite so as to, by inflating under the pressure of the air propelled into the tunnel for traversing the pile of products, close the space (E) in question and limit the circulation of air in passages existing between the sealing device products.

3. Sealing device according to claim 2, characterised in that:

each sheet (1) has two edges, (1A, 1B), one (1A) situated upstream and the other (1B) downstream of the tunnel relative to the direction of circulation of the air through the products stacked on the pallet, and between these edges (1A, 1B), the sheet (1) has an extent larger than the rectilinear distance separating said edges (1A, 1B) so as to constitute a flexible pocket, at the level of the downstream edge (1A) of each sheet, the sheet (1) is fixed, at least indirectly, against the face (5A) of the tunnel (5) at the level from which the sheet extends, at the level of the upstream edge (1B) of each sheet, the sheet (1) is kept spaced from the face (5A) of the tunnel (5) at the level from which the sheet extends so that the propelled air is able to be caught inside the volume delimited by the sheet and the face of the tunnel, and such that an increase of the resultant pressure causes this sheet (1) to be applied against products and support unit (4).

* * * * *